US010730054B2

(12) United States Patent
Käppeler et al.

(10) Patent No.: US 10,730,054 B2
(45) Date of Patent: Aug. 4, 2020

(54) METHOD AND DEVICE FOR FRAGMENTING AND/OR WEAKENING POURABLE MATERIAL BY MEANS OF HIGH-VOLTAGE DISCHARGES

(71) Applicant: selFrag AG, Kerzers (CH)

(72) Inventors: Johannes Käppeler, Laupen (CH); Reinhard Müller-Siebert, Bern (CH)

(73) Assignee: selFrag AG, Kerzers (CH)

( * ) Notice: Subject to any disclaimer, the term of this patent is extended or adjusted under 35 U.S.C. 154(b) by 490 days.

(21) Appl. No.: 15/536,159

(22) PCT Filed: Feb. 27, 2015

(86) PCT No.: PCT/CH2015/000030
§ 371 (c)(1),
(2) Date: Jun. 15, 2017

(87) PCT Pub. No.: WO2016/134488
PCT Pub. Date: Sep. 1, 2016

(65) Prior Publication Data

US 2017/0326555 A1 Nov. 16, 2017

(51) Int. Cl.
*B02C 19/18* (2006.01)
*B02C 23/12* (2006.01)
(Continued)

(52) U.S. Cl.
CPC ..... *B02C 19/18* (2013.01); *B02C 23/12* (2013.01); *B02C 23/22* (2013.01); *B02C 23/36* (2013.01); *B02C 2019/183* (2013.01)

(58) Field of Classification Search
CPC ..... B02C 19/18; B02C 19/183; B02C 23/36; B02C 23/22; B02C 23/12; B02C 23/02; B01J 19/08
(Continued)

(56) References Cited

U.S. PATENT DOCUMENTS 3,208,674 A 9/1965 Bailey
3,604,641 A * 9/1971 Wilson ..... B02C 19/18 241/301
(Continued)

FOREIGN PATENT DOCUMENTS

BE 864969 A2 7/1978
DE 19545580 A1 6/1997
(Continued)

OTHER PUBLICATIONS

International Search Report for International Application No. PCT/CH2015/000031, dated Dec. 11, 2015.
(Continued)

*Primary Examiner* — Faye Francis
(74) *Attorney, Agent, or Firm* — Marshall, Gerstein & Borun LLP

(57) ABSTRACT

A method for fragmenting and/or weakening pourable material includes guiding a material stream of pourable material immersed in a process liquid along an annular or arcuate channel past a high-voltage electrode assembly. The high-voltage electrode assembly, which includes one or more generators, generates high-voltage punctures through the material flow. Material is supplied to the material stream upstream of the high voltage electrode arrangement. Material is guided away from the material stream downstream of the high-voltage electrode assembly.

22 Claims, 14 Drawing Sheets

(51) Int. Cl.
*B02C 23/22* (2006.01)
*B02C 23/36* (2006.01)

(58) Field of Classification Search
USPC ..... 241/1
See application file for complete search history.

(56) References Cited

U.S. PATENT DOCUMENTS

| | | | | |
|---|---|---|---|---|
| 4,182,216 | A | 1/1980 | DeCaro | |
| 4,540,127 | A * | 9/1985 | Andres | B02C 19/18 241/1 |
| 6,039,274 | A * | 3/2000 | Zinoviev | B02C 19/18 241/1 |
| 7,246,761 | B2 * | 7/2007 | Hoppe | B02C 19/18 166/248 |
| 7,677,486 | B2 * | 3/2010 | Hoppe | B02C 19/18 241/301 |
| 10,399,085 | B2 * | 9/2019 | Muller | B02C 19/18 |
| 2005/0051644 | A1 * | 3/2005 | Paris | B02C 19/18 241/1 |
| 2005/0180841 | A1 | 8/2005 | Cao | |
| 2007/0187539 | A1 * | 8/2007 | Hoppe | B02C 19/18 241/301 |
| 2008/0283639 | A1 * | 11/2008 | Frey | B02C 19/18 241/20 |
| 2014/0130335 | A1 | 5/2014 | Bickford et al. | |

FOREIGN PATENT DOCUMENTS

| | | | |
|---|---|---|---|
| DE | 19727534 | A1 | 1/1999 |
| DE | 197 36 027 | A1 | 3/1999 |
| DE | 19902010 | A1 | 8/2000 |
| DE | 69913493 | T2 | 5/2004 |
| FR | 982415 | A | 6/1951 |
| FR | 2302441 | A1 | 9/1976 |
| GB | 854830 | A | 11/1960 |
| JP | H09192526 | A | 7/1997 |
| JP | 2003154286 | A | 5/2003 |
| KR | 20120139638 | A | 12/2012 |
| RU | 2263545 | C1 | 11/2005 |
| RU | 113177 | U1 | 2/2012 |
| RU | 2667750 | C1 | 9/2018 |
| RU | 2670126 | C1 | 10/2018 |
| SU | 1178487 | A1 | 9/1985 |
| SU | 1538928 | A1 | 1/1990 |
| SU | 888355 | A1 | 11/1991 |
| WO | WO-1999003588 | A1 | 1/1999 |
| WO | WO-2013053066 | A1 | 4/2013 |

OTHER PUBLICATIONS

International Search Report for PCT/CH2015/000032, dated Dec. 4, 2015.
International Search Report for PCT/CH2016/000033, dated Jun. 6, 2016.
International Search Report for PCT/CH2015/000181, dated Mar. 10, 2016.
Written Opinion for international application No. PCT/CH2015/000181, dated Dec. 10, 2015.
Decision to Grant related application RU 2 670 126, dated Aug. 24, 2018.
Decision to Grant related application RU 2667750, dated Aug. 15, 2018.
International Search Report for PCT/CH2015/000030, dated Dec. 14, 2015.

* cited by examiner

METHOD AND DEVICE FOR FRAGMENTING AND/OR WEAKENING POURABLE MATERIAL BY MEANS OF HIGH-VOLTAGE DISCHARGES

CROSS-REFERENCE TO RELATED APPLICATIONS

This is the United States national phase of International Patent Application No. PCT/CH2015/000030, filed Feb. 27, 2015. Each of the foregoing is expressly incorporated herein by reference in the entirety.

TECHNICAL FIELD

The invention relates to a method for fragmenting and/or weakening pourable material by means of high voltage discharges as well as to a device for carrying out the method according to the preambles of the independent claims.

BACKGROUND

From the prior art it is known how to fragment a variety of materials by means of pulsed high voltage discharges or to weaken them in such a way that they can be fragmented easier in a subsequent mechanical fragmenting process.

Different process types for the fragmenting and/or weakening of pourable material by means of high voltage discharges are known today.

In case of small material quantities, the fragmenting and/or the weakening of the material is done in batch operation in a closed process container, inside which high voltage punctures through the material are generated. These methods are unsuitable for large material quantities.

For large material quantities, the fragmentation and/or weakening of the material is done in a continuous process by passing a material stream composed of the material to fragment past one or more high voltage electrodes, by means of which high voltage punctures through the material are generated.

Thereby, in a first alternative, the material is guided into a process space with sieve openings, from where it can only leave when it is fragmented to a target size defined by the sieve openings. The speed with which the material is guided through the process space, and consequently the intensity with which the material is charged with high voltage punctures, depends in this alternative on how fast the material can be fragmented entirely to the target grain size or grain sizes which are smaller than the target grain size, respectively. This results in the disadvantage that the process can only be influenced within narrow margins, which can lead to problems like excessive fragmentation of the material, undesired high fine grain percentage and/or bad energy efficiency of the process.

In a second alternative, the material is passed below one or more high voltage electrodes by means of a transport belt and high voltage punctures are generated through the material. This alternative avoids the above mentioned disadvantages of the first alternative, how it has itself the disadvantage that potentially not sufficiently processed material emerging from this process has to be separated and to be fed to the process again, for which purpose expensive and space-consuming additional installations are required.

GENERAL DESCRIPTION

It is therefore the objective to provide continuous methods for fragmenting and/or weakening pourable material by means of high voltage discharges as well as devices for carrying out such methods, which don't have the aforementioned disadvantages of the prior art or at least minimize them.

This objective is reached by the subject matters of the independent claims.

According to these, a first aspect of the invention relates to a method for fragmenting and/or weakening pourable material, particularly rock pieces or gravel, by means of high voltage discharges.

According to this method, an annular or arcuate material stream of pourable material, which is preferably circular or circular-segment-shaped, is formed from the pourable material to fragment and/or to weaken and, immersed in a process liquid, is guided past a high voltage electrode arrangement, by means of which high voltage punctures through the material stream are generated during guide of the material stream past the high voltage electrode arrangement. For this, the high voltage electrode arrangement is charged with high voltage pulses by means of one or more high voltage generators. Material streams which circulate in a closed transport loop are understood in the context of this description and the patent claims as "annular material streams", independently from the shape of this loop.

Material is supplied to the material stream upstream of the high voltage electrode arrangement and material is guided away from the material stream downstream of the high voltage electrode arrangement.

The method according to the invention makes it possible to provide a continuous process for fragmenting and/or weakening pourable material, in case of which the speed with which the material is guided through the process zone and the intensity with which the material is charged with high voltage punctures can be adjusted within large margins and in case of which potentially not sufficiently processed material leaving the process zone can be supplied to the process zone again on the shortest path and practically without additional space requirement, e.g. by remaining in the material stream or as a bypass material stream leading through a zone surrounded by the annular and/or arcuate material stream.

Preferably, no material is guided away from the material stream in the area of the process zone, thus in the area where high voltage punctures are generated through the material stream by the high voltage electrode arrangement. In this way it is possible to create a simple and robust structure of the process zone.

In a preferred embodiment of the method, a partial stream of the material stream or the entire material stream is guided downstream of the high voltage electrode arrangement into a central section which is surrounded by the annular or arcuate material stream. By using the area surrounded by the annular or arcuate material stream for further process steps, like the discharge of material and/or the separation of sufficiently fragmented material from material which is not sufficiently fragmented, the advantage results that no additional space has to be provided for these process steps.

Accordingly, it is preferred in an alternative that at least a part of the material guided into the central section is guided out of this section.

In a further variant it is preferred that at least a part of the material guided into the central section is guided back into the annular or arcuate material stream, consequently forming a bypass material stream to the latter, and is subsequently again guided past by the high voltage electrode arrangement.

In a preferred combination of the two aforementioned alternatives, the material guided into the central section is separated by means of a separation device arranged in the central section, e.g. by means of a sieve, in completely processed material and not completely processed material, i.e. in sufficiently fragmented material and not sufficiently fragmented material. The completely processed material is guided out of the central section, while the not completely processed material is guided back into the annular or arcuate material stream. In this way very compact installations for carrying out the method according to the invention are possible, in case of which additional space has to be provided only for the supply of the material to be processed and for discharging the completely processed material.

In a further preferred embodiment of the method, the annular or arcuate material stream is formed by supplying the material onto a carousel-type device, e.g. in an annular channel, and by guiding it past the high voltage electrode arrangement by rotating this device around a substantially vertical axis running through the central section. In this way it is possible to form an annular or arcuate material stream in an easy way.

In yet a further preferred embodiment of the method, a high voltage electrode arrangement is used, which comprises a matrix-type arrangement of a plurality of high voltage electrodes, each of which is charged with high voltage pulses. In this way it is possible to reach an intense and extensive charging of the passed-by material stream with high voltage punctures.

If the matrix-type electrode arrangement extends across an area larger than 180° of the annular or arcuate material stream, which is preferred, it is possible to reach an intense charging of the same with high voltage punctures even at a relatively high speed of the material stream and a correspondingly large quantity of material per time unit can be processed.

Each of the high voltage electrodes of the matrix has preferably its own high voltage generator, by means of which it is charged with high voltage pulses independently from the other high voltage electrodes. In this way it is possible to ensure a uniform and high energy introduction into the material stream over the entire surface of the matrix or to charge targeted individual sections with different energy quantities.

According to a preferred embodiment of the method, an element is used as opposite electrode for the high voltage electrodes of the high voltage electrode arrangement, which limits the bottom side of the material stream in the area of the high voltage electrode arrangement, such that by charging the high voltage electrodes with high voltage pulses, high voltage punctures can occur between the respective high voltage electrode and this element. Preferably, this element is the floor of a carousel-type device, by means of which the material stream is guided past the high voltage electrode arrangement. Preferably, the high voltage electrodes of the high voltage electrode arrangement are immersed in the material stream. This method alternative allows acting particularly intensely on the material of the material stream, because the high voltage punctures occur across the entire thickness of the material stream.

In another preferred embodiment of the method, each high voltage electrode is attributed to one or more own opposite electrodes, i.e. exclusively attributed to the respective high voltage electrode, which is or are arranged laterally neighboring and/or below the respective high voltage electrode, in such a way that high voltage punctures are generated through the material of the material stream between the high voltage electrode and the opposite electrode or electrodes by charging the respective high voltage electrode with high voltage pulses. Preferably, the high voltage electrodes and/or the opposite electrodes are immersed in the material stream.

This results in the advantage that the puncture voltage is substantially decoupled from the thickness of the material, such that even material streams made of large material pieces can be readily processed. A further advantage of this embodiment consists in that it offers a highest possible design freedom with respect to the support surface or the transport device for the material stream in the area of the process zone, because the floor surface of the process zone is not required as opposite electrode.

Thereby it is further preferred in case of the last mentioned preferred embodiment that the opposite electrodes are supported by the respective high voltage electrode or by their supporting structure.

In yet a further preferred embodiment of the method, the material of the outer and/or the inner edge area of the annular or arcuate material stream is not guided away, but rotates continuously as continuous annular or arcuate material stream.

In another preferred embodiment of the method, material from the middle section of the material stream is guided away at a first position downstream of the high voltage electrode arrangement. The material of the outer and/or the inner edge area is guided at least partially into the middle section of the material stream at a second position downstream of the first position, advantageously into the area from where material was previously guided away at the first position. New material is supplied in the outer and/or inner edge section of the material stream at a third position downstream of the second position, before the material stream is again guided past the high voltage electrode arrangement and is charged with high voltage punctures.

In yet another embodiment of the method, the inner and/or the outer edge section of the material stream is limited or are limited, respectively, by substantially unmoved sections of the same material in the area of the process zone, i.e. along the area where high voltage punctures through the material of the material stream are generated.

These three aforementioned preferred embodiments can also be combined, e.g. in such a way that the outer edge section rotates continuously as continuous annular or arcuate material stream or is guided into the middle section of the material stream downstream of the high voltage electrode arrangement, while the inner edge section is limited at least in the area along the process zone by substantially unmoved sections of the same material. Thereby, it is further preferred that the material guided away from the material stream is guided into a central section which is surrounded by the annular or arcuate material stream.

If in case of this last mentioned preferred embodiments of the method according to the invention the width of the process zone, i.e. the width of the zone where the high voltage punctures are generated through the material, is chosen, as seen in moving direction of the material stream, in such a way that these outer and/or inner edge sections limit the process zone laterally and are thereby substantially not charged with high voltage punctures, which is preferred, the advantage results that it is possible to do without wear-sensitive installation-sided devices for lateral limitation of the actual process zone and a contamination with another material is avoided.

In the last mentioned preferred embodiment of the method, in case of which the inner and/or the outer edge section of the material stream is limited by substantially unmoved sections of the same material along the process zone, it is further preferred that these substantially unmoved areas are formed in such a way that the edge sections of the material stream accumulate at a position downstream of the high voltage electrode arrangement, such that unmoved material zones extend laterally along the entire length of the process zone.

In yet a further preferred embodiment of the method, the high voltage electrode arrangement has one or more high voltage electrodes which are shiftable independently from one another along particularly parallel, particularly vertically oriented shift axes. These high voltage electrodes are shifted in such a way along the shift axes while guiding the material stream past the high voltage electrode arrangement and generating high voltage punctures through the material stream that they follow each the contour of the material stream at a certain distance or follow the contour of the material stream in contact with its surface and are at the same time immersed in the process liquid. In this way it is possible to process material streams with very irregular thickness, e.g. of very coarse material pieces or of material pieces with very different sizes.

It is further preferred that each high voltage electrode of the high voltage electrode arrangement has its own high voltage generator by means of which it is charged with high voltage pulses independently from the other high voltage electrodes. In this case it is possible, particularly for high voltage electrode arrangements which are formed as matrix of high voltage electrodes, to ensure a uniform and high energy introduction into the material stream along all high voltage electrodes or to charge targeted individual high voltage electrodes with different energy quantities.

Thereby it is further preferred that the high voltage generator is firmly connected to the high voltage electrode. In this way, a secure connection between the respective high voltage electrode is ensured and the respective high voltage generator and the respective high voltage electrode can be exchanged and maintained as unit.

A second aspect of the invention relates to a device for carrying out the method according to the first aspect of the invention. This device has a high voltage electrode arrangement which is charged with high voltage pulses by means of one or more high voltage generators, as well as a carousel-type device, by means of which pourable material can be guided, particularly by rotating it around a central and substantially vertical axis, as annular or arcuate material stream, which is particularly a circular or circular-segment-shaped material stream, past the high voltage electrode arrangement, immersed into a process fluid, below the high voltage electrode arrangement, such that high voltage punctures through the material of the material stream are generated while it is guided past the high voltage electrode arrangement when the high voltage electrode arrangement is charged with high voltage pulses. Furthermore, the device has means for supplying material upstream of the high voltage electrode arrangement to the annular or arcuate material stream generated by means of the carousel-type device during use as intended, as well as means for guiding away material from this material stream downstream of the high voltage electrode arrangement.

By way of the device according to the invention it is possible to implement a continuous process for fragmenting and/or weakening pourable material with little space requirement, in case of which the speed with which the material is guided through the process zone and the intensity with which it is charged with high voltage punctures can be adjusted easily within large margins. With such a device it is also possible to supply potentially not sufficiently processed material leaving the process zone again to the process zone, on the shortest path and practically without additional space requirement, e.g. by leaving it in the material stream or as a bypass material stream extending through a zone surrounded by the annular and/or arcuate material stream.

In a preferred embodiment of the device, its carousel-type device has sieve openings in the area in which it carries the material forming the annular or arcuate material stream in operation as intended, as means according to the claims for guiding away material, via which sieve openings material which is smaller than the sieve openings can be guided away from the material stream. Thereby it is preferred as sub-alternative that the carousel-type device forms an annular or arcuate channel with rotating sieve floor, inside which in operation as intended the material to be fragmented and/or weakened is received and which is rotated about the center of its annular shape for generating the annular or arcuate material stream. Thereby it is also provided that also in the process zone material which is smaller than the sieve openings can leave the channel through the sieve openings and can thereby be guided away from the material stream during charging the material with high voltage punctures. Such devices can be manufactured relatively simply and inexpensively and they are easy to maintain, however they have the disadvantage that the sieve openings widen with increasing operating time and the sieve floor is therefore a wear part.

In another preferred embodiment of the device, the carousel-type forms a closed floor in the area in which it carries the material forming the annular or arcuate material stream in operation as intended. The means for guiding away the material are formed in such a way, e.g. as one or multiple guiding installations, that with them a partial stream of the material stream, particularly from the middle of the material stream, or the entire material stream, can be guided into a central section in the center of the carousel-type device, which is surrounded by the annular or arcuate material stream. This yields the advantage that potential further devices for the transport and/or the further processing of the material guided away from the material stream can be arranged in the area surrounded by the annular or arcuate material stream, like transport devices for guiding away completely processed material from the device (e.g. belt drives or material slides) and/or devices for separating sufficiently fragmented material from not sufficiently fragmented material (e.g. sieve devices), such that no additional space has to be provided for these devices.

Accordingly, it is advantageous for this preferred embodiment of the device that the device has such devices in the central section.

In a further alternative of this embodiment it is preferred that the device has means for guiding back at least a part of the material guided into the central section into the annular or arcuate material stream, e.g. one or more guiding installations for this purpose. In this way it is possible to inject material which was guided into the central section back into the annular or arcuate material stream and process it again.

Thereby it is particularly preferred that the device has a separation installation in the central section, e.g. a sieve, by means of which the material guided into this section can be separated in completely processed material and not completely processed material and in that subsequently the completely processed material can be guided out of the central section with transport means and guided away from the device, while the not completely processed material can be supplied into the annular or arcuate material stream with the means for guiding back the material, in order to charge it again with high voltage punctures.

In this way it is possible to provide very compact devices according to the invention, in case of which space only has to be provided for supplying the material to be processed and for guiding away the completely processed material out of the central section.

In a further preferred embodiment, the device has means by which it is possible to effect during use as intended that the inner edge section and/or the outer edge section of the annular or arcuate material stream is or are limited, respectively, substantially by unmoved sections of the same material in the process zone, i.e. in the zone where high voltage punctures are generated through the material of the material stream. In other words, these means have the effect that the zone of the material stream, where high voltage punctures through the material of the material stream are generated, is limited on the inner side and/or outer side, as seen in moving direction of the material stream, by unmoved sections or zones made of the same material. In this way, the lateral limitations of the zone of the moved material, where the high voltage punctures take place (process zone), is formed by identical but substantially unmoved material.

Thereby, the device is preferably formed in such a way that in operation as intended, during the passage of the material stream past the high voltage electrode arrangement, the material of the material stream accumulates in the lateral sections of the zone where the high voltage punctures through the material of the material stream are generated, as a substantially unmoved material zone, which is substantially untouched by the high voltage punctures. Advantageously, the device has for this purpose installations for the targeted accumulation of the material stream, e.g. baffle plates or lateral limitation walls for the material stream with recesses where the material is accumulated.

Due to the fact that the lateral limitations of the zone of the unmoved material stream, where the high voltage punctures take place (process zone), are formed by identical but substantially unmoved material, it is possible to avoid wear-intense installations, which has a positive effect on the operation costs and on the idle times due to maintenance of the device and additionally makes possible a process execution with low contamination with different material.

In yet a further preferred embodiment, the device is formed in such a way that in operation as intended material from the middle section of the material stream is guided away downstream of the high voltage electrode arrangement, while the material of the outer and/or the inner edge section of the annular or arcuate material stream remains there and rotates continuously as annular or arcuate material stream.

In yet a further preferred embodiment, the device is formed in such a way that in operation as intended material is guided away from the central section of the material stream at a first position downstream of the high voltage electrode arrangement, the material of the outer and/or inner edge section is guided at least partially into the middle of the material stream at a second position downstream of the first position, and new material is supplied into the outer and/or inner edge section of the material stream at a third position downstream of the second position, before the material stream is again guided past the high voltage electrode arrangement and is charged with high voltage punctures.

The two last mentioned embodiments of the device according to the invention also have the advantage that the lateral limitations of the zone of the material stream, where the high voltage punctures take place (process zone), are formed by identical material, such that it is possible to avoid wear-intense installations for lateral limitation of the actual process zone also in case of these devices, with the aforementioned advantageous effects on the operating costs, the maintenance-related idle times of the device and the contamination with different materials.

The three last mentioned preferred embodiments can also be combined, e.g. in such a way that the device is formed such that the outer edge section circulates continuously as continuous annular or arcuate material stream or is guided into the middle section of the material stream downstream of the high voltage electrode arrangement, while the inner edge section of the material stream is limited by substantially unmoved sections made of the same material at least in the section along the process zone.

Preferably, the area of the carousel-type installation, where the latter carries the material forming the annular or arcuate material stream in operation as intended, is limited at its outer circumference by a limitation wall closed with respect to circumference, and wherein the device is formed in such a way that this limitation wall is moved together with the material of the material stream, i.e. during generation of the annular or arcuate material stream by rotation of the carousel-type installation, in operation as intended of the device. For such devices it is particularly easy to implement that the outer edge section rotates continuously as continuous annular or arcuate material stream or is guided into the middle section of the material stream downstream of the high voltage electrode arrangement.

It is also preferred that the area of the carousel-type installation, where the latter carries the material forming the annular or arcuate material stream in operation as intended, is limited at its inner circumference by a fixed limitation wall which is interrupted downstream of the high voltage electrode arrangement. In this way it is possible in a simple way to guide material from the material stream into a central section of the device which is surrounded by the annular or arcuate material stream. Accordingly, the means for guiding away material from the material stream are formed in such a way, e.g. as a deflection metal sheet entering the material stream radially, that material from the annular or arcuate material stream is guided through this interruption, in operation as intended, into a central section in the center of the carousel-type installation.

This type of device offers the possibility to provide a zone of unmoved material of the material stream as inner limitation of the process zone, by accumulating the material stream in the area of its inner edge space upstream of the interruption, with the already described advantages.

Thereby, according to a first preferred alternative, the means for guiding away material from the material stream are formed or adjustable in such a way that the entire annular or arcuate material stream is guided into the central section in operation as intended, and, according to a second preferred alternative, the means for guiding away material from the material stream are formed or adjustable in such a way that material of the outer edge section of the annular or arcuate material stream is not guided into the central section in operation as intended, but circulates continuously as continuous annular or arcuate material stream. The first alternative is particularly suitable in case the process zone extends across the entire width of material stream and/or in case a separation installation, e.g. a sieve, is arranged in the central section, by means of which the completely processed material is separated from the not completely processed material.

The high voltage electrode arrangement of the device preferably comprises a matrix-type arrangement made of multiple high voltage electrodes, each of which are charged with high voltage pulses. Such high voltage electrode arrangements allow an intense and extensive charging of the passing by material stream with high voltage punctures.

If the matrix-type electrode arrangement extends across an area larger than 180° of the annular or arcuate material stream, which is preferred, it is possible to reach an intense charging of the latter with high voltage punctures even at a relatively high speed of the material stream and to process a correspondingly high quantity of material per time unit.

It is also advantageous that each high voltage electrode of the matrix has an own high voltage generator by means of which this high voltage electrode can be charged with high voltage pulses independently from the other high voltage electrodes. In this way it is possible to ensure a uniform and high energy introduction into the material stream across the entire surface of the matrix or to charge targeted individual high voltage electrodes with different energy quantities.

In yet a further preferred embodiment of the device, the high voltage electrode arrangement has high voltage electrodes which are shiftable along particularly parallel, particularly vertically oriented shifting axes independently from one another.

These high voltage electrodes can be shifted along their shifting axes automatically in such a way that each of them follows the contour of the material stream at a certain distance or each of them follows the contour of the material stream in contact with the latter, being immersed in the process liquid, by means of a machine controller in operation as intended during the guiding of the material stream past the high voltage electrode arrangement and the generation of high voltage punctures through the material stream. In this way it is possible to process material streams with very irregular thickness, e.g. of very coarse material pieces or of material pieces with very different sizes.

If each high voltage electrode has its own high voltage generator, it further preferred that the high voltage generator is firmly connected to the respective high voltage electrode and is shiftable with it along the shifting axes. In this way, a secure connection between the respective high voltage electrode is ensured and the respective high voltage generator and the respective high voltage electrode can be exchanged and maintained as unit.

According to a first preferred alternative of the device, an element of the carousel-type installation is used as opposite electrode for the high voltage electrodes of the high voltage electrode arrangement, which limits the bottom side of the material stream in the area of the high voltage electrode arrangement, on which the annular or arcuate material forming the material stream is supported. Preferably, this element is the floor of an annular or arcuate channel (with or without sieve openings), inside which the material is arranged and by its rotation about its annular center is guided past the high voltage electrode arrangement as circular material stream. This device alternative allows acting particularly intensely on the material of the material stream, because the high voltage punctures occur across the entire thickness of the material stream.

In another preferred embodiment, each high voltage electrode has one or more own opposite electrodes, i.e. exclusively attributed to the respective high voltage electrode, which is or are arranged laterally neighboring and/or below the respective high voltage electrode, in such a way that high voltage punctures are generated through the material of the material stream between the high voltage electrode and the opposite electrode or electrodes by charging the respective high voltage electrode with high voltage pulses, particularly in the preferred case that the high voltage electrodes and/or the opposite electrodes are immersed in the material stream.

This has the advantage that the puncture voltage is substantially decoupled from the thickness of the material stream, such that even material streams with high material pieces can be readily processed. A further advantage of this embodiment is that it offers a highest possible design freedom with respect to the support surface or the transport device for the material stream in the area of the process zone, because the floor surface of the process zone is not required as opposite electrode.

Thereby, it is further preferred in case of the last mentioned preferred embodiment that the opposite electrodes are carried by the respective high voltage electrode or by their supporting structure, respectively.

BRIEF DESCRIPTION OF THE DRAWINGS

Further embodiments, advantages and applications of the invention result from the dependent claims and from the now following description by the drawings. It is shown in:

DETAILED DESCRIPTION

Figure 1:
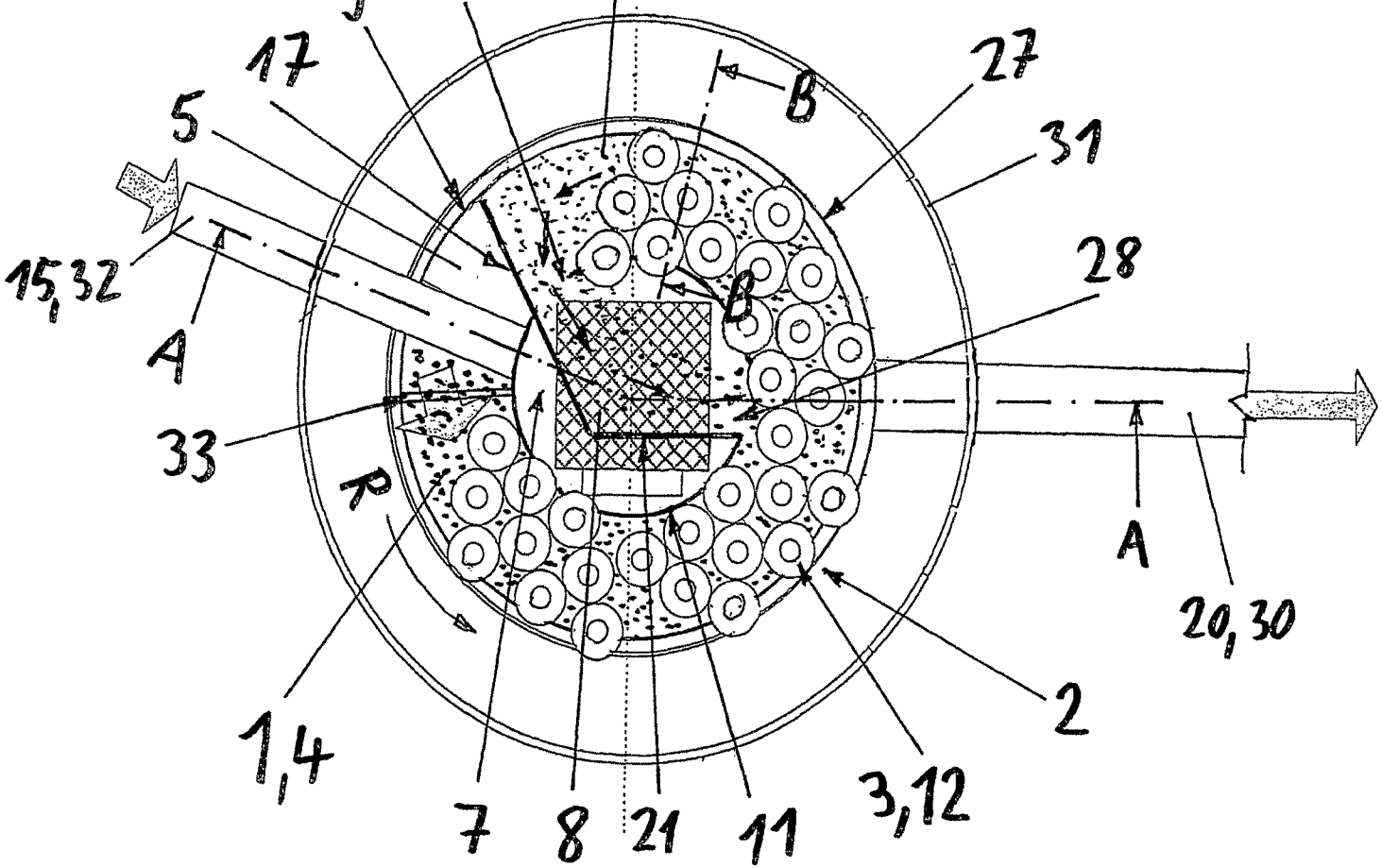
FIG. 1 a top view on a first device according to the invention in a first type of operation.
Figure 2:
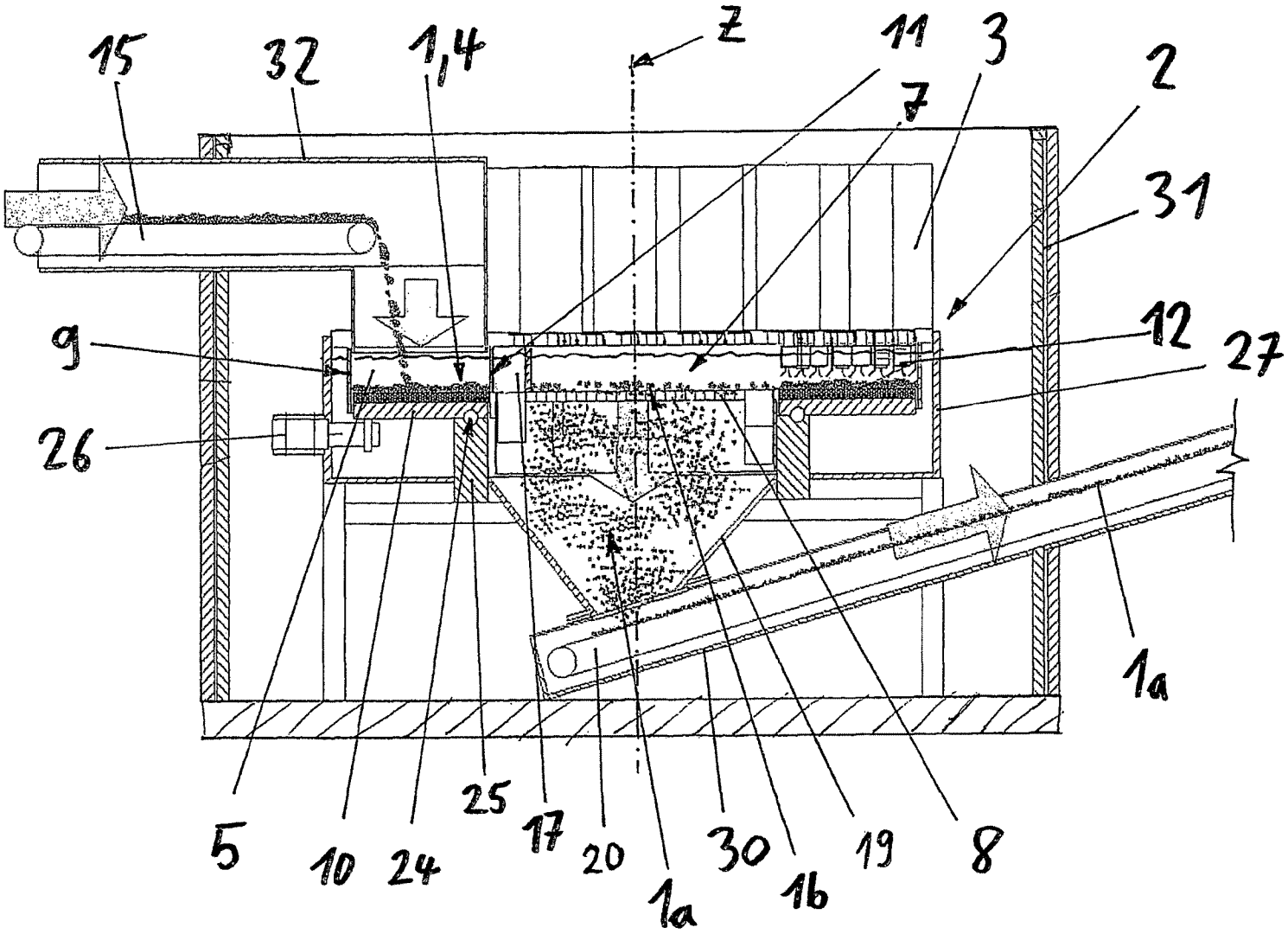
FIG. 2 a vertical section through the first device along the line A-A of FIG. 1.
Figure 3:
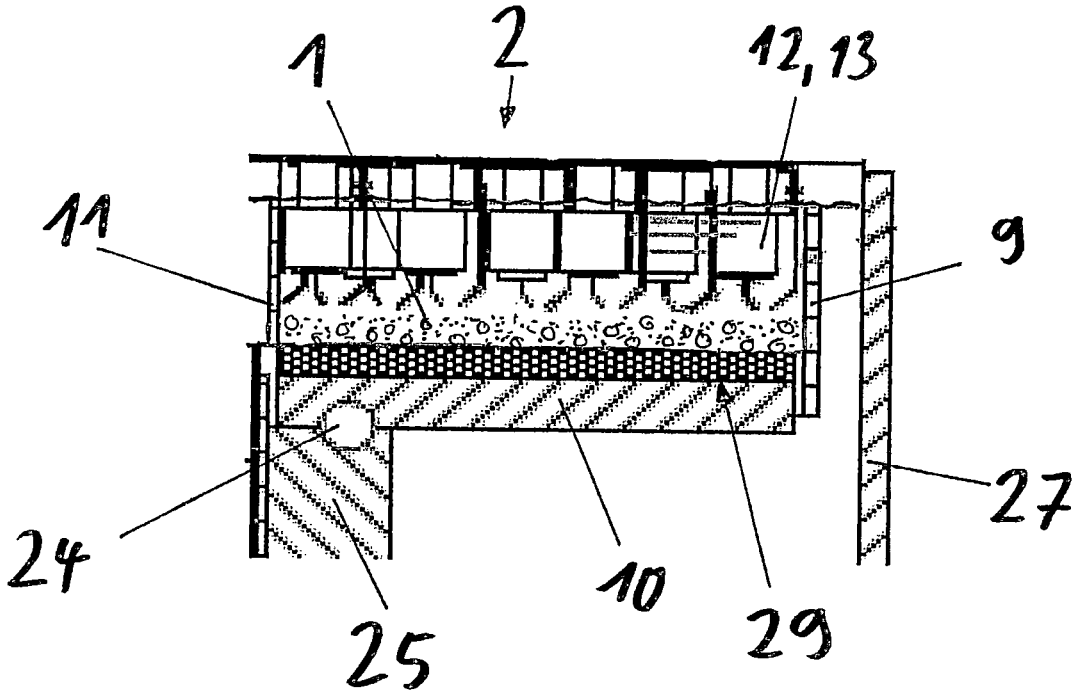
FIG. 3 a vertical section through the first device along the line B-B of FIG. 1.

FIG. 1 to 3 show a first device according to the invention for fragmenting pourable material 1 by means of high voltage punctures, once in a top view from above (FIG. 1), once in a vertical section along the line A-A of FIG. 1 (FIG. 2) and once in a partial vertical section along the line B-B of FIG. 1 (FIG. 3).

As can be seen, the device has a carousel-type installation 9, 10, 11, formed by an annular floor plate 10, a cylindrical outer wall 9 firmly connected to the floor plate 10 and protruding perpendicularly upward from the floor plate 10 and with a cylindrical inner wall 11 not connected to the floor plate 10 and protruding perpendicularly upward from the floor plate 10. The floor plate 10 is even and continuously closed and it is supported on a annular supporting element 25 of a fixed supporting structure by means of a roller race 24, and is rotated in operation as intended about a vertical rotation axis Z running through the center of the annular shape of the floor plate 10 in a rotation direction R by means of a drive motor 26, wherein the material 1 to be fragmented, which is lying on the floor plate 10, forms a annular or annular-segment-shaped material stream 4 in rotation direction R around the rotation axis Z.

The carousel-type installation 9, 10, 11 is arranged inside a circular pool 27 filled with water 5 (process liquid), the floor of which is penetrated by the annular supporting element 25. The carousel-type installation 9, 10, 11 is entirely immersed in the water 5 in the pool 27 except the upper limitation edges of the outer wall 9 and of the inner wall 11. In the area inside the annular supporting element 25, the floor of the pool 27 is formed by a circular funnel 19 extending downwards, the bottom end of which ends above a transport band 20 which transports obliquely upward until a level above the water level of the pool 27 (not shown entirely here due to space reasons) and which is arranged inside a housing 30, which is connected at the bottom funnel end and forms together with the pool 27 a watertight tank. The pool 27 is surrounded by an annular protecting wall 31, through which the housing of the transport band 30 and the transport band 20 protrude.

As it can further be seen, the device has a high voltage electrode arrangement 2 with a plurality of high voltage electrodes 12 arranged in a matrix-shaped manner above the carousel-type installation 9, 10, 11, wherein the high voltage electrode arrangement extends across an area of 270° of the annular shape of the carousel-type installation 9, 10, 11. Each of the high voltage electrodes 12 protrudes downward from the top up to just above the surface of the annular-segment-shaped material stream 4 transported in the carousel-type installation 9, 10, 11, wherein it dives into the water 5 and has an own high voltage generator 3 arranged directly above it, by means of which in operation it is charged with high voltage pulses. In the figures, only one of the high voltage electrodes is shown with the reference number 12 and only one of the high voltage generators are shown with the reference number 3, due to clarity reasons.

Figure 12:
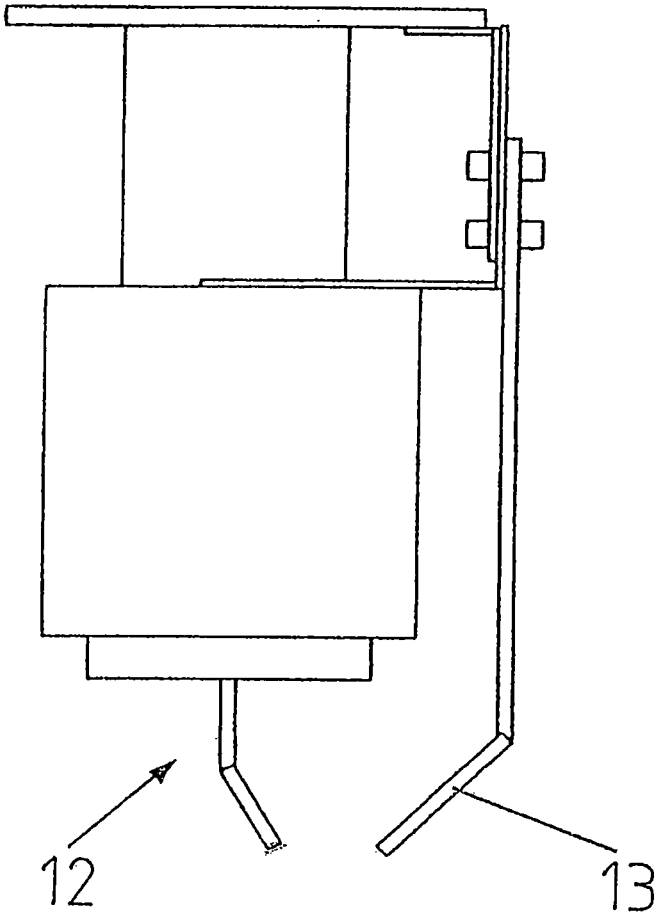
FIG. 12 a side view of one of the high voltage electrodes of the devices.

As can be seen in FIG. 12, which shows one of the high voltage electrodes 12 of the high voltage electrode arrangement 2 of this device in the side view, each of the high voltage electrodes 12 has an own opposite electrode 13 which is grounded and which is arranged in such a way with respect to the respective high voltage electrode 12 that, in operation as intended shown in the figures, high voltage punctures between the high voltage electrode 12 and the opposite electrode 13 attributed to it are generated through the material 1 of the material stream 4 by charging the respective high voltage electrode 12 with high voltage pulses.

As can further be seen, the device has a supplying transport band 15 arranged inside a closed housing 32, by means of which material 1 to be fragmented, in the present case pieces of noble metal ore 1, is delivered on the floor plate 10 of the carousel-type installation 9, 10, 11 upstream of the high voltage electrode arrangement 2.

The height of the material bed 1 passed below the high voltage electrode arrangement 2 as annular-segment-shaped material stream 4 is determined by a passage limitation sheet metal 33 before the inlet into the area (process zone) between the carousel-type installation 9, 10, 11 and the high voltage electrode arrangement 2.

A fixed first guiding sheet metal 17 is located downstream of the high voltage electrode arrangement 2, which extends from the outer wall 9 of the carousel-type installation 9, 10, 11 through a first interruption 23 into its inner wall 11 into a section 7 in the center of the carousel-type installation 9, 10, 11 and guides the material stream 4 exiting the process zone into the central section 7 substantially entirely via the first interruption 23 in the inner wall 11 in operation as intended.

The floor of the central section 7 is formed as even sieve floor 8, with a sieve opening size which is dimensioned in such a way that material fragmented to target size 1*a* passes through the sieve openings and falls into the funnel 19 arranged below, while material 1*b* which is larger than the target size remains on the sieve floor 8. The completely processed material 1*a* or the material fragmented to target size, respectively, is guided from the funnel 19 onto the transport band 20, by means of which it is transported out of the device.

The not completely processed material or the material not yet fragmented to target size, respectively, is pushed on the sieve floor 8 and is guided out of the central section 7 from a second fixed guiding sheet metal 21 following the first guiding sheet metal 17 via a second interruption 28 in the inner wall 11 back into the annular-segment-shaped material stream 4, by means of which it is again guided past a part of the high voltage electrode arrangement 2 and charged with high voltage punctures.

As seen in FIG. 3, which shows a vertical section through a part of the first device in the area of the process zone along the line B-B of FIG. 1, the floor plate 10 of the carousel-type installation 9, 10, 11 has a top side coated with a wear-reducing rubber layer 29, on which the material 1 to be processed is located.

Figure 4:
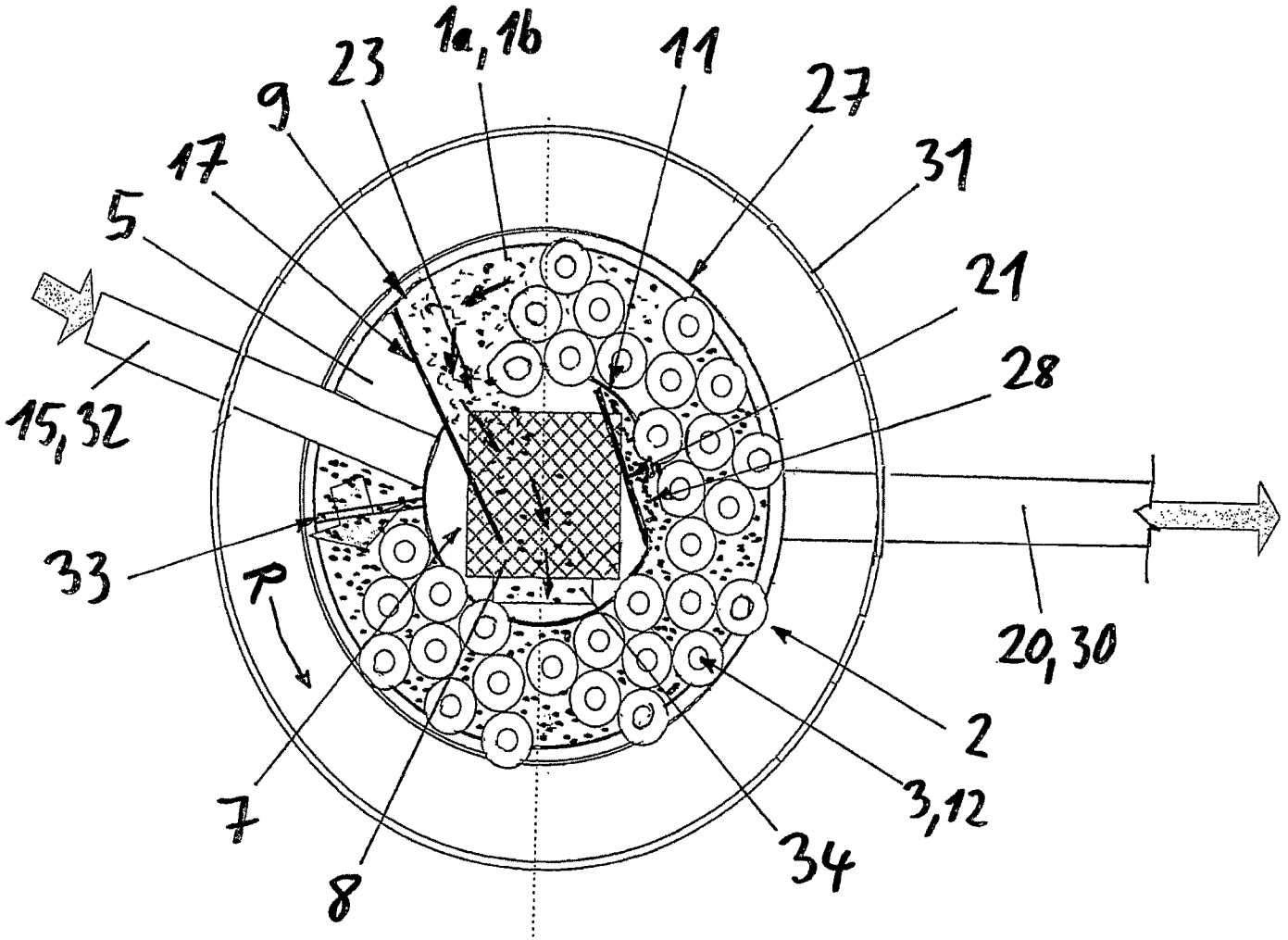
FIG. 4 a top view on the first device according to the invention in a second type of operation.

FIG. 4 shows a top view on the device in another operating way. As can be seen, here the second guiding sheet metal 21 is arranged in a position where it closes the second interruption 28 in the inner wall 11 from the side of the central section 7 and frees one discharge shaft 34, into which the not completely processed material or the material not yet fragmented to target size 1*b*, which is pushed on the sieve floor 8 by the incoming material 1, falls and subsequently is discharged from the device with installations (not shown).

Figure 5:
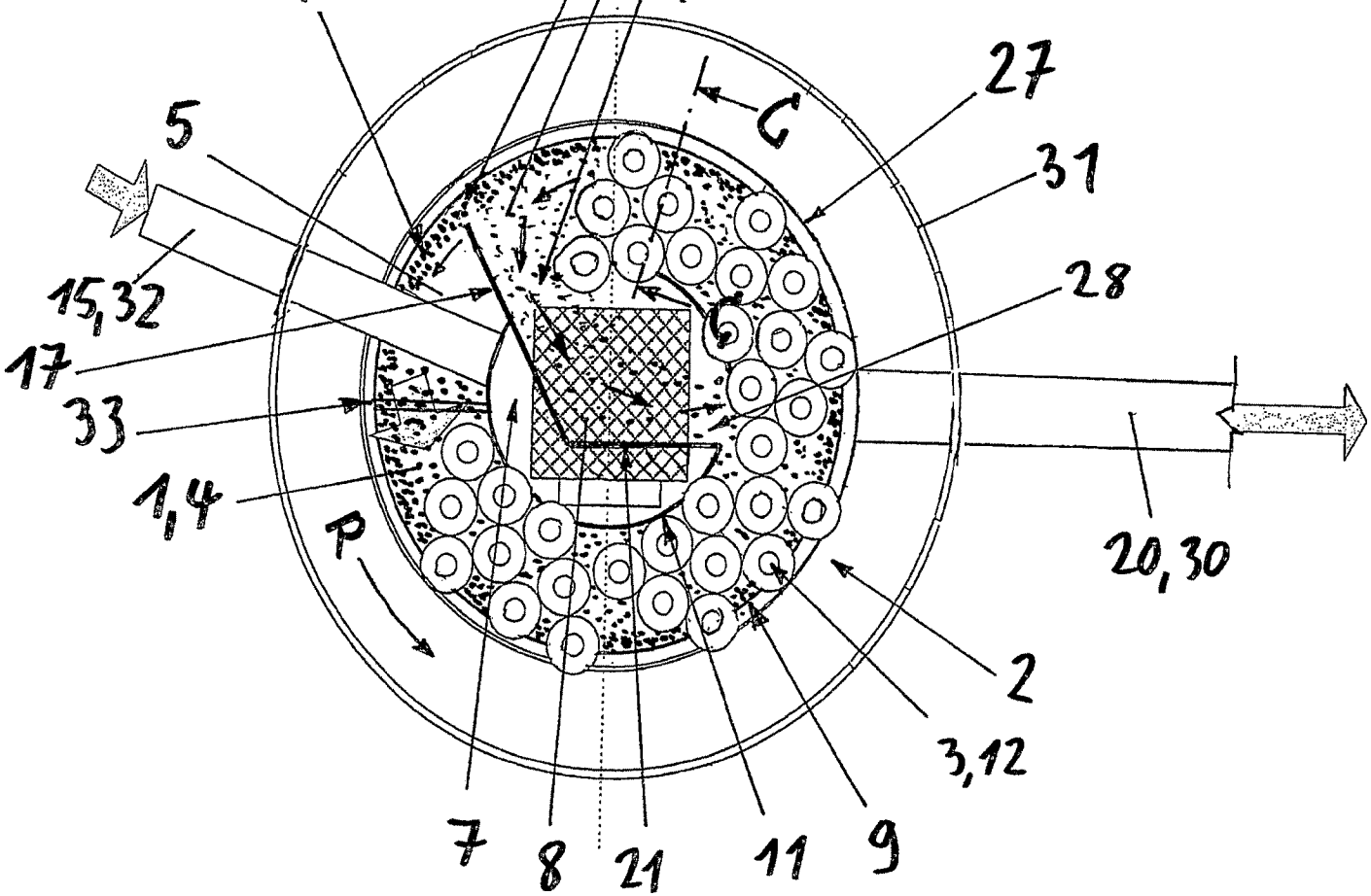
FIG. 5 a top view on a second device according to the invention.
Figure 6:
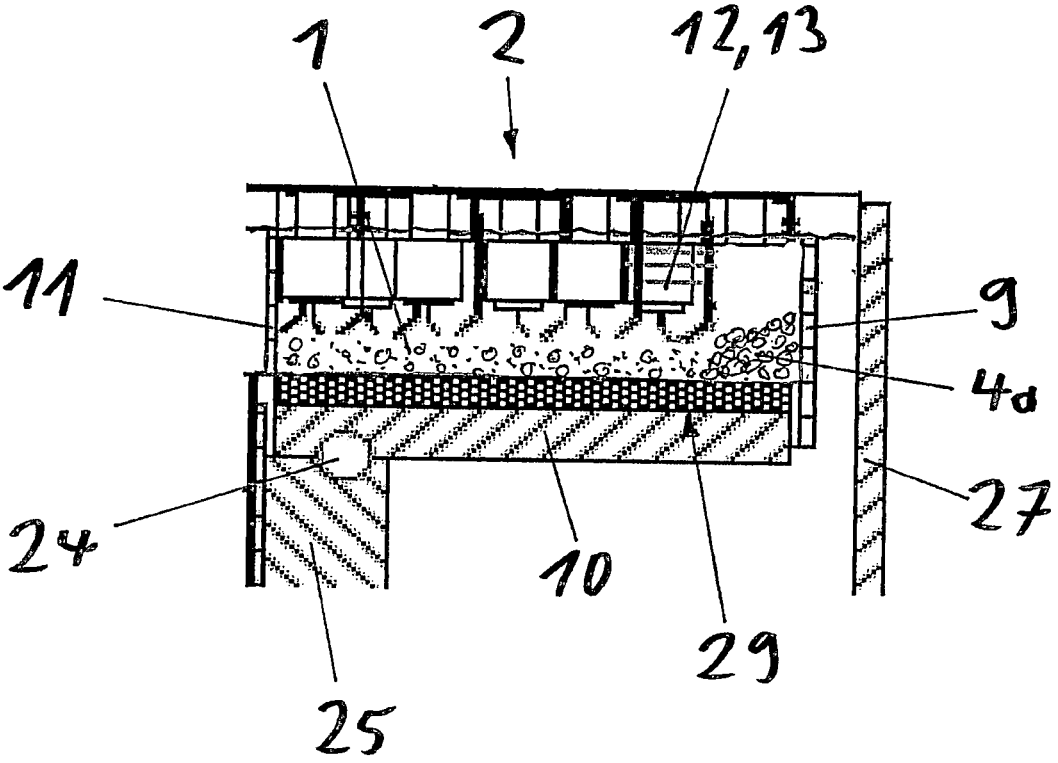
FIG. 6 a vertical section through the second device along the line C-C of FIG. 5.

FIGS. 5 and 6 show a second device according to the invention for fragmenting pourable material 1 by means of high voltage discharges, once in a top view from above (FIG. 5) and once in a partial vertical section along the line C-C of FIG. 5 (FIG. 6).

This device differs from the device shown in FIGS. 1 to 3 substantially in that here the first guiding sheet metal 17 arranged downstream of the high voltage electrode arrangement 2 doesn't extend entirely up to the outer wall 9 of the carousel-type installation 9, 10, 11, such that between its outer end and the outer wall 9 an opening 35 is formed, through which the material 1 can pass in the outer edge section of the material stream 4, such that it is not guided by the first guiding sheet metal 17 into the central section 7 but rotates continuously as continuous annular material stream 4*a*. Accordingly, here not the entire material stream 4 exiting the process zone is guided into the central section 7, but only material 1 from its middle section and from its inner edge section.

As particularly visible in FIG. 6, a further difference of this device to the device shown in FIG. 1 to 4 is that here the high voltage electrodes 12 of the high voltage electrode arrangement 2 are arranged in such a way that the rotating material stream 4*a* is substantially not charged with high voltage punctures, in the outer edge section of the material stream 4. Accordingly, the material 1 has substantially the initial piece size in the outer edge section of the material stream 4.

For the rest, this second device has an identical structure like the first device.

Figure 7:
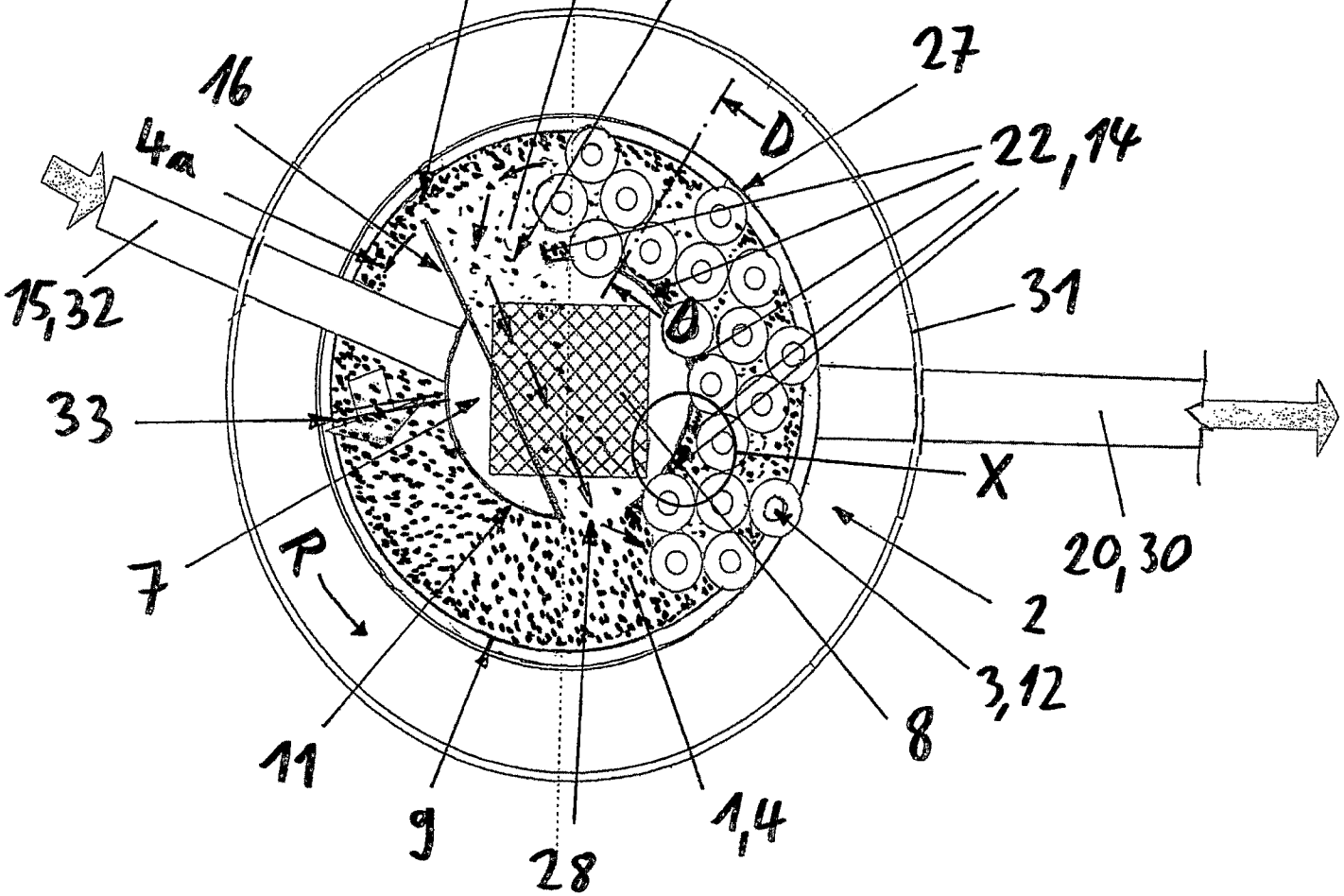
FIG. 7 a top view on a third device according to the invention.
Figure 8:
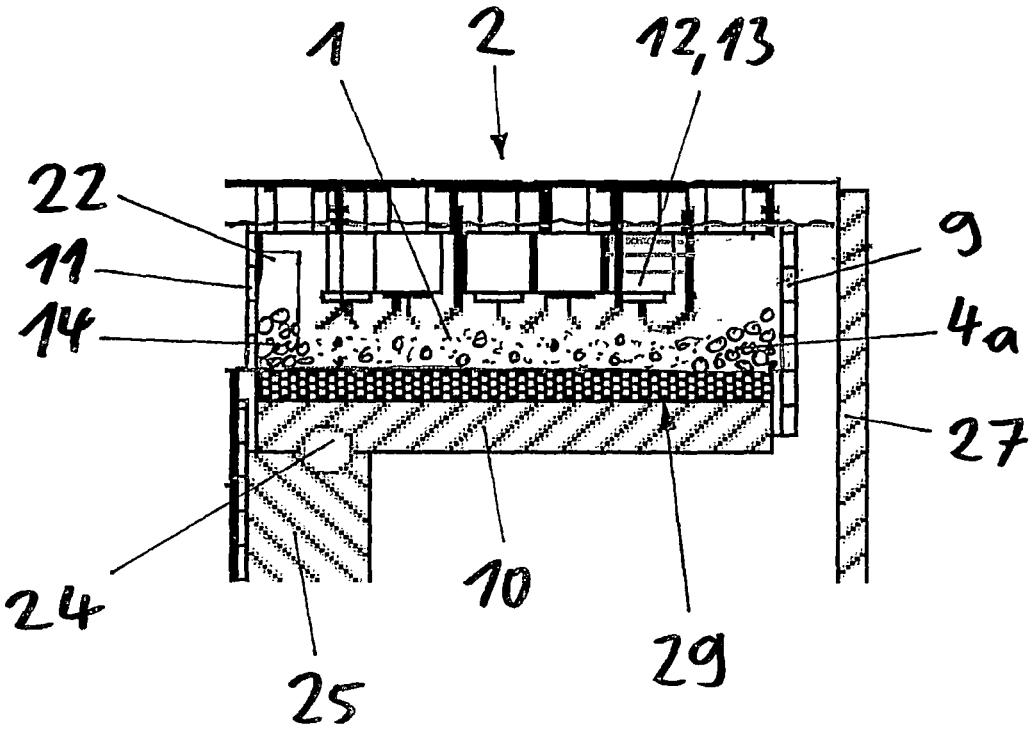
FIG. 8 a vertical section through the third device along the line D-D of FIG. 7.

FIGS. 7 and 8 show a third device for fragmenting pourable material 1 by means of high voltage discharges according to the invention, once in a top view from above (FIG. 7) and once in a partial vertical section along the line D-D of FIG. 7 (FIG. 8).

This device differs from the device shown in FIGS. 5 and 6 first in that here the matrix-shaped high voltage electrode arrangement 2 has less high voltage electrodes 12 and extends only across an area of about 170° of the annular shape of the carousel-type installation 9, 10, 11.

Figure 7A:
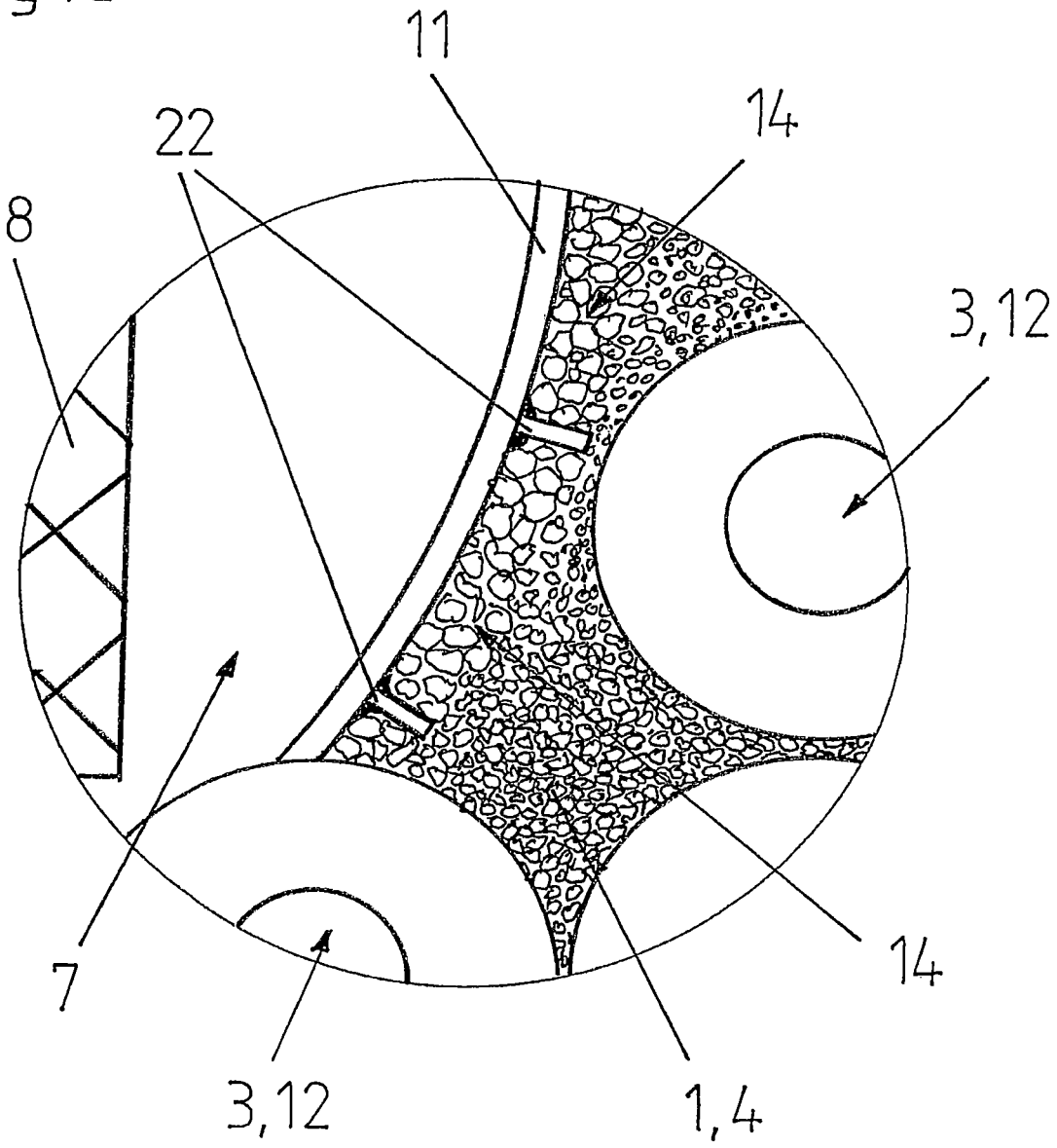
FIG. 7*a* the detail X of FIG. 7.

As can be seen in connection with FIG. 7*a*, which shows the detail X of FIG. 7, a further difference is that the inner wall 11 of the carousel-type installation 9, 10, 11 has on its side facing the material stream 4, in the area where the high voltage electrode arrangement 2 extends above the carousel-type installation 9, 10, 11, multiple accumulation ribs 22 which extend radially into the material stream 4, by means of which the material 1 is accumulated in the inner edge section of the material stream 4 as unmoved material zones 14. Thereby, the high voltage electrodes 12 of the high voltage electrode arrangement 2 are arranged here in such a way that the unmoved material zones 14 are substantially not charged with high voltage punctures in the inner edge section of the material stream 4. Accordingly, the material 1 has substantially its original piece size in these zones 14.

Still a further difference is that this device has a single fixed guiding sheet metal 16 which guides the material 1, downstream of the high voltage electrode arrangement 2, from the middle section and from the inner edge section of the material stream 4 moving along the unmoved material zones 14 via the first interruption 23 in the inner wall 11 into the central section 7 and onto the sieve floor 8 and additionally also guides the material 1*b* which remains on the sieve floor 8 and which wasn't fragmented to target size or which is not completely processed, respectively, via a second interruption 28 arranged at a position upstream of the high voltage electrode arrangement 2, back into the material stream 4.

For the rest, this third device has an identical structure like the second device.

Figure 9:
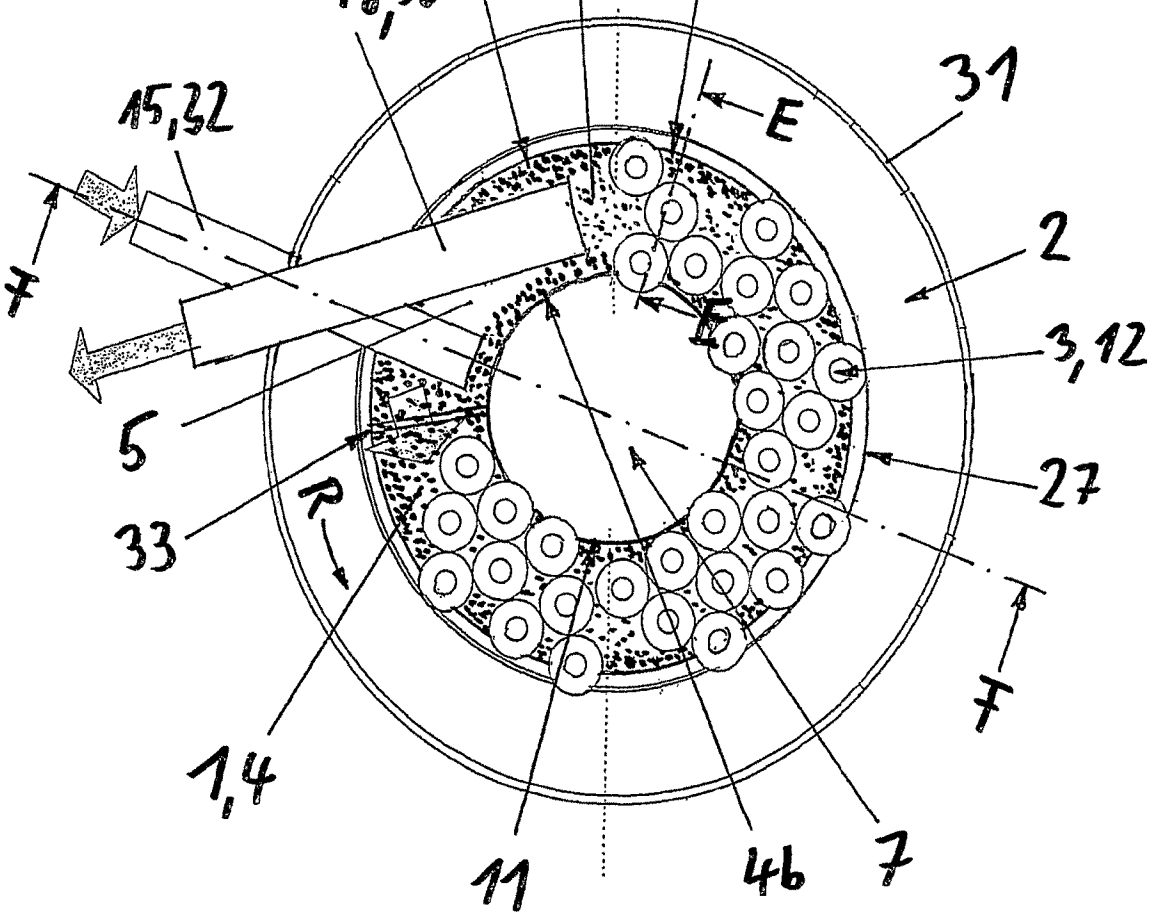
FIG. 9 a top view on a fourth device according to the invention.
Figure 10:
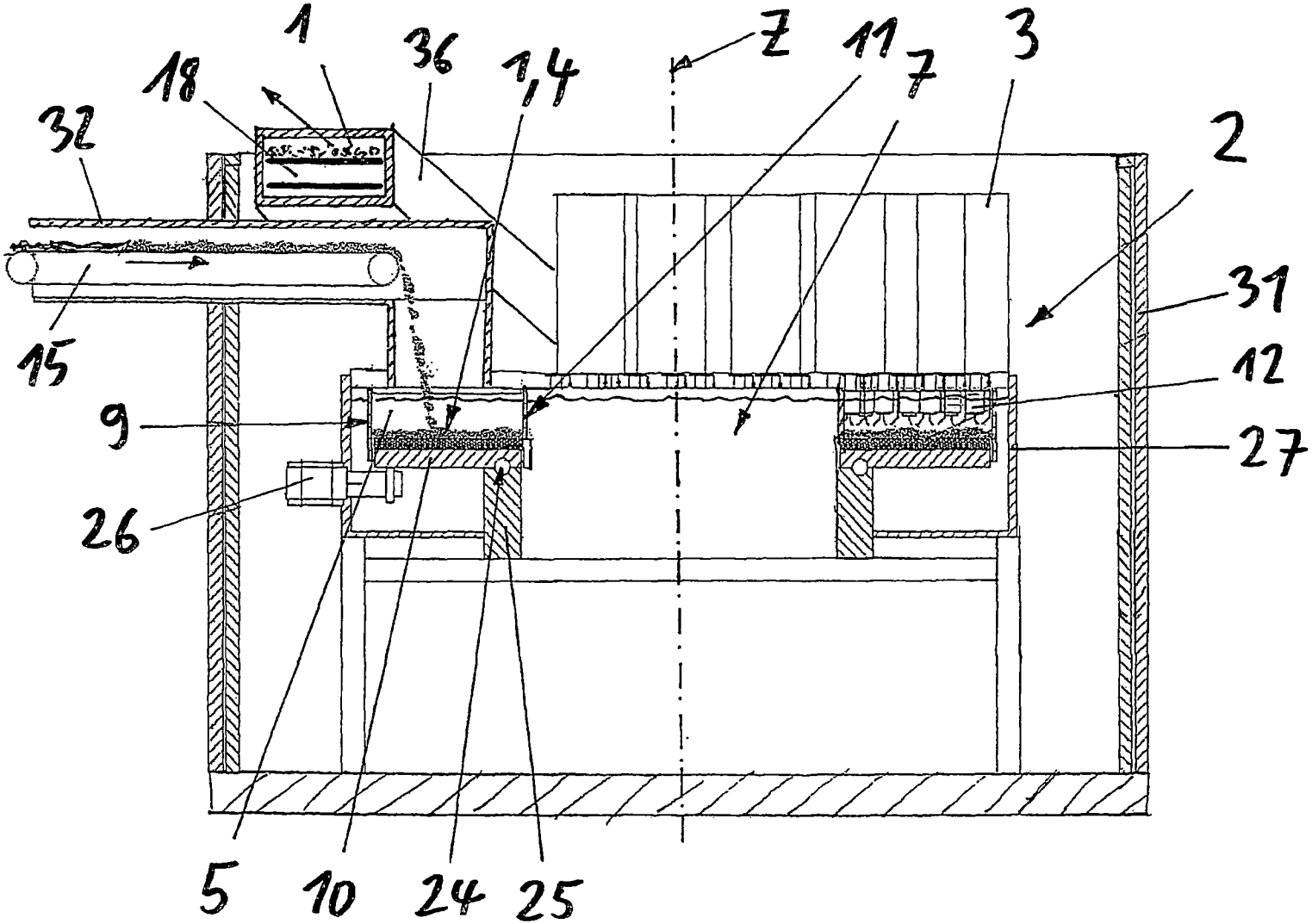
FIG. 10 a vertical section through the fourth device along the line F-F of FIG. 9.
Figure 11:
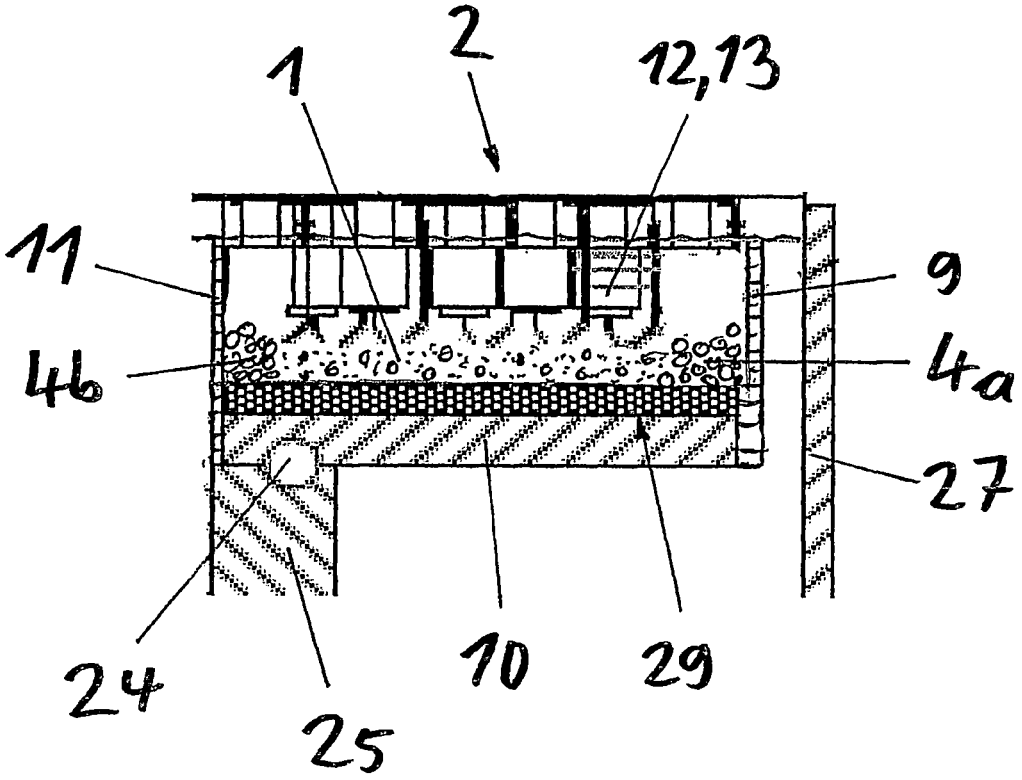
FIG. 11 a vertical section through the fourth device along the line E-E of FIG. 9.

FIG. 9 to 11 show a fourth device for fragmenting pourable material 1 by means of high voltage discharges according to the invention, once in a top view from above (FIG. 9), once in a vertical section along the line F-F of FIG. 9 (FIG. 10) and once in a partial vertical section along the line E-E of FIG. 9 (FIG. 11).

This device differs from the devices shown in FIG. 1 to 8 in that it doesn't have installations by means of which the material stream 4 exiting the process zone or a part of it is guided into the center 7 of the carousel-type installation 9, 10, 11. The inner wall 11 has no interruptions here and is firmly connected to the floor plate 10 of the carousel-type installation 9, 10, 11, such that they rotate about the rotation axis Z together with it and with the outer wall 9. The carousel-type installation 9, 10, 11 therefore forms in this case a closed annular channel which rotates about the rotation axis Z.

In case of the device shown here, the material 1 from the middle section of the material stream 4, which exits the process zone formed between the floor plate 10 of the carousel-type installation 9, 10, 11 and the high voltage electrode arrangement 2, is removed and guided away from the device by means of a removal transport band 18 arranged inside a housing 36, which receives the material 1 from the floor plate 10 by means of a (not shown) inlet sheet metal.

The material 1 in the outer edge section and in the inner edge section of the material stream 4 remains on the floor plate 10 and rotates as continuous annular material stream 4*a*, 4*b*.

Contrary to the first device shown in FIGS. 1 to 4, here the high voltage electrodes 12 of the high voltage electrode arrangement 2 are arranged in such a way that the rotating partial material streams 4*a*, 4*b* are not charged with high voltage punctures in the outer and in the inner edge section of the material stream 4. Accordingly, the material 1 has its initial piece size in these partial material streams 4*a*, 4*b*.

New material to be fragmented 1 is delivered via the supplying transport band 18, downstream of the removal position of the removal transport band 18, into the middle section of the annular floor plate 10, such that downstream of this delivery position a closed material stream 4 of substantially unprocessed material 1 is present again, which is delivered to the process zone again.

For the rest, this fourth device has an identical structure like the first device.

Figure 13:
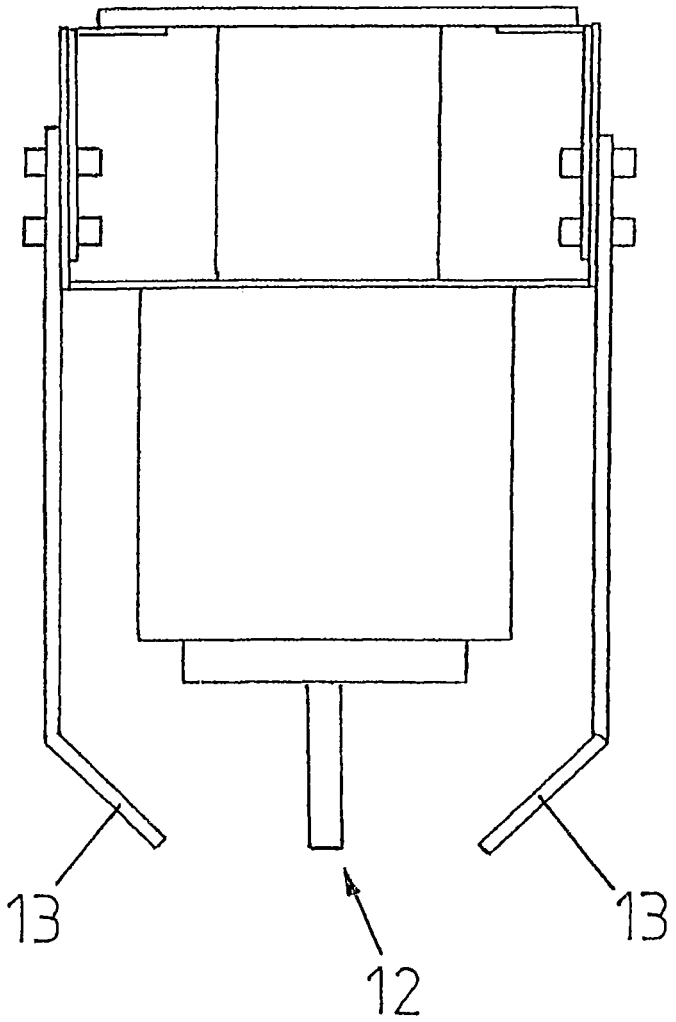
FIG. 13 a side view of an alternative of the high voltage electrode of FIG. 12.

FIG. 13 shows a further high voltage electrode 12 for the aforementioned devices according to the invention, which differs from the one shown in FIG. 12 substantially in that it has two identical opposite electrodes 13 arranged face to face in a mirrored way. A further difference is that this high voltage electrode 12 has a straight electrode tip.

While in the present application preferred embodiments of the invention are described, it is clearly noted that the invention is not limited thereto and may be executed in other ways within the scope of the now following claims.

The invention claimed is:

1. Method for fragmenting and/or weakening pourable material by high voltage discharges, the method comprising:

a) providing a high voltage electrode arrangement and one or more high voltage generators configured to charge the high voltage electrode arrangement with high voltage pulses;

b) guiding a material stream of pourable material, immersed in a process liquid, along an annular or arcuate channel past the high voltage electrode arrangement; and c) generating high voltage punctures through the material stream while guiding the material stream past the high voltage electrode arrangement by charging the high voltage electrode arrangement with high voltage pulses, wherein material is supplied to the material stream upstream of the high voltage electrode arrangement and material is guided away from the material stream downstream of the high voltage electrode arrangement.

2. The method according to claim 1, wherein material is guided away from the material stream only downstream of the high voltage electrode arrangement.

3. The method according to claim 1, wherein a partial stream of the material stream or all of the material stream is guided downstream of the high voltage electrode arrangement into a central section surrounded by the annular or arcuate channel.

4. The method according to claim 3, wherein at least a part of the material guided into the central section is guided out of the central section.

5. The method according to claim 3, wherein at least a part of the material guided into the central section is guided back from the central section into the material stream.

6. The method according to claim 4, wherein the material guided into the central section is separated by a separation device into completely processed material and not completely processed material and the completely processed material is guided out of the central section, while the not completely processed material is guided back into the material stream.

7. The method according to claim 1, wherein the material stream is formed by supplying the material onto a carousel and guiding the material past the high voltage electrode arrangement by rotating the carousel around a substantially vertical axis running through a central section.

8. The method according to claim 1, wherein the high voltage electrode arrangement comprises an arrangement of a plurality of high voltage electrodes, each high voltage electrode charged with high voltage pulses.

9. The method according to claim 8, wherein the arrangement of high voltage of electrodes extends across more than 180° of the annular or arcuate channel.

10. The method according to claim 1, wherein the high voltage electrode arrangement comprises a plurality of high voltage electrodes, and wherein the annular or arcuate channel is provided in a device that has a floor, the floor configured for use as an opposite electrode for the plurality of high voltage electrodes.

11. The method according to claim 1, wherein the high voltage electrode arrangement comprises a plurality of high voltage electrodes, and wherein the method further comprises providing opposite electrodes, each opposite electrode only associated with one of the plurality of high voltage electrodes and arranged laterally beside and/or below the one of the plurality of high voltage electrodes, and generating high voltage punctures through the material stream between the plurality of high voltage electrodes and the opposite electrodes by charging the plurality of high voltage electrodes with high voltage pulses.

12. The method according to claim 1, wherein a portion of the material stream along an outer edge section and/or an inner edge section of the annular or arcuate channel rotates continuously as continuous annular or arcuate material stream.

13. The method according to claim 1, wherein material from a portion of the material stream guided along a middle section of the annular or arcuate channel is guided away at a first position downstream of the high voltage electrode arrangement, material from a portion of the material stream guided along an outer edge section and/or an inner edge section of the annular or arcuate channel is guided at least partially into the middle section of the annular or arcuate channel at a second position downstream of the first position, and new material is supplied to a portion of the material stream guided along the outer edge section and/or the inner edge section of the channel at a third position downstream of the second position before the material stream is again guided past the high voltage electrode arrangement.

14. The method according to claim 1, wherein material from the material stream is stationary at an inner edge section and/or an outer edge section of the channel in an area where high voltage punctures through the material of the material stream are generated.

15. The method according to claim 14, wherein the material from the material stream that is stationary is retained downstream of the high voltage electrode arrangement.

16. The method according to claim 12, wherein the continuous rotation of the portion of the material stream along the inner edge section of the annular or arcuate channel is directed by material from the material stream that is stationary in an area where high voltage punctures through the material of the material stream are generated.

17. The method according to claim 13, wherein the material from a portion of the material stream guided along the outer edge section of the annular or arcuate channel is guided at the second position at least partially into a middle of the material stream and new material is supplied into the portion of the material stream guided along the outer edge section of the material stream at the third position before the material stream is again guided past the high voltage electrode arrangement.

18. The method according to claim 3, wherein material from a middle section of the material stream is guided away downstream from the high voltage electrode arrangement and into the central section.

19. The method according to claim 1, wherein the high voltage electrode arrangement has one or more high voltage electrodes which are shiftable independently from one another along parallel, vertically oriented shift axes, and wherein these high voltage electrodes, while guiding the material stream past the high voltage electrode arrangement and generating high voltage punctures through the material stream, are shifted in such a way along their shift axes that each of the high voltage electrodes follows a contour of the material stream and are at the same time immersed into the process liquid.

20. The method according to claim 11, wherein the high voltage electrode arrangement has one or more high voltage electrodes which are shiftable independently from one another along parallel, vertically oriented shift axes, wherein each opposite electrode is shifted along the shift axis together with the one of the plurality of high voltage electrodes with which it is an associated.

21. The method according to claim 1, wherein the high voltage electrode arrangement includes a plurality of high voltage electrodes, each high voltage electrode in electrical communication with a respective high voltage generator configured to charge the high voltage electrode with high voltage pulses independently from other high voltage electrodes.

22. The method according to claim 21, wherein each high voltage generator is connected to a respective high voltage electrode.

* * * * *